US006778061B2

(12) United States Patent
Nakano et al.

(10) Patent No.: US 6,778,061 B2
(45) Date of Patent: Aug. 17, 2004

(54) FUSE

(75) Inventors: Mitsuhiko Nakano, Saitama (JP); Takeshi Sakai, Kanagawa (JP)

(73) Assignee: Daito Communication Apparatus Co., Ltd., Tokyo (JP)

( * ) Notice: Subject to any disclaimer, the term of this patent is extended or adjusted under 35 U.S.C. 154(b) by 0 days.

(21) Appl. No.: 10/386,750

(22) Filed: Mar. 12, 2003

(65) Prior Publication Data

US 2004/0021546 A1 Feb. 5, 2004

(30) Foreign Application Priority Data

Aug. 5, 2002 (JP) ..... 2002-226812

(51) Int. Cl.[7] ..... H01H 69/02; H01H 85/143; H01H 85/157

(52) U.S. Cl. ..... 337/248; 337/232; 337/186; 337/228

(58) Field of Search ..... 337/186, 290, 337/414, 231, 232, 237, 248, 251–255, 227, 228, 166, 245, 246, 273, 158, 279, 260, 297, 234; 29/623

(56) References Cited

U.S. PATENT DOCUMENTS 1,121,876 A * 12/1914 Schipper ..... 337/234
1,388,269 A * 8/1921 William ..... 337/237
1,502,881 A * 7/1924 Maurits ..... 337/250
1,881,369 A * 10/1932 Carney ..... 337/234
2,017,491 A * 10/1935 Glowacki ..... 337/234
2,077,823 A * 4/1937 Carney ..... 337/253
2,168,153 A * 8/1939 Brown ..... 337/234
2,522,473 A * 9/1950 Vischer, Jr. ..... 337/234
2,929,900 A * 3/1960 White ..... 337/246
3,460,086 A * 8/1969 Fister ..... 337/202
3,648,210 A * 3/1972 Kozacka ..... 337/161
4,001,749 A * 1/1977 Kozacka ..... 337/244
4,158,187 A * 6/1979 Perreault ..... 337/248
4,205,294 A * 5/1980 Jacobs, Jr. ..... 337/234
4,646,053 A * 2/1987 Mosesian ..... 337/232
4,651,119 A * 3/1987 Belcher et al. ..... 337/166
4,910,490 A * 3/1990 Knapp et al. ..... 337/248
4,972,169 A * 11/1990 Kalra ..... 337/163
4,996,509 A * 2/1991 Bernstein ..... 337/232
5,812,046 A * 9/1998 Brown et al. ..... 337/290
6,147,585 A * 11/2000 Kalra et al. ..... 337/248

* cited by examiner

*Primary Examiner*—Anatoly Vortman
(74) *Attorney, Agent, or Firm*—Dennis G. LaPointe; Mason Law, P.L.

(57) ABSTRACT

A fuse that can be made small while improving its breaking performance. An element 3 is securely held between the two lengthwise ends of a tubular fuse casing 2 and a pair of metal plates 4 having a melting point of more than 1000° C. The ends of the fuse casing 5 are respectively pushed into caps 5 so that the caps are fitted to the fuse casing 2 in such a manner as to cover the metal plates 4. The metal plates 4 protect the caps 5 from direct exposure to an arc discharge, which occurs when the element 3 fuses due to an overcurrent. Even if the fuse casing is made small, the metal plates 4 reliably interrupt overcurrent by absorbing the energy of an arc discharge.

3 Claims, 2 Drawing Sheets

FUSE

BACKGROUND OF THE INVENTION

The present invention relates to a fuse provided with a fuse element.

A typical example of conventional fuses of this type has a tubular fuse casing with a through hole formed therethrough. A cap serving as a terminal is fitted to each axial end of the fuse casing. A fuse element adapted to melt by an overcurrent is inserted through the through hole of the fuse casing, with each end of the fuse element welded to the inside of each respective cap.

SUMMARY OF THE INVENTION

An arc discharge occurs immediately after the fuse element fuses due to an overcurrent. However, should a fuse having a structure described above be made small, reduction of the space inside the through hole of the fuse casing may cause the arc discharge to increase the internal pressure of the fuse casing excessively, resulting in damage to the fuse casing.

When the fuse is made small, the distance between the two caps is reduced. As the reduction of the distance between the caps makes an arc discharge occurring at the time of fusion of the fuse element difficult to interrupt, the energy of the arc discharge may form a hole in a cap or otherwise prevent the reliable cutting off of the over current from the circuit to be protected.

In other words, the fuse described above is not easy to be made small while improving its breaking performance.

In order to solve the above problems, an object of the present invention is to provide a fuse that can be made small while improving its breaking performance.

One embodiment of the present invention includes a tubular fuse casing, a pair of metal plates which are respectively attached to the two ends of the fuse casing and have a melting point of more than 1000° C., a pair of terminals respectively fitted to the two ends of the fuse casing in such a manner as to cover said metal plates, and a fuse element disposed in the fuse casing with each end portion of the fuse element electrically connected to each respective terminal in such a state as to be held between each respective end of the fuse casing and the metal plate attached thereto, said fuse element being able or adapted to fuse when subjected to an overcurrent.

As the fuse element of the fuse is securely held between the two lengthwise ends of the tubular fuse casing and the pair of metal plates having a melting point of more than 1000° C., and the terminals are fitted over the metal plates, the metal plates protect the terminals from direct exposure to an arc discharge, which occurs when the fuse element fuses due to an overcurrent. Therefore, even if the internal space of the fuse casing or the distance between the terminals is reduced as a result of the fuse casing being made small, the metal plates reliably interrupt overcurrent by absorbing the energy that sustains the arc discharge. The fuse can thus be made small while achieving an improved breaking performance.

Another embodiment of the present invention is a fuse, which includes a tubular fuse casing, a pair of metal plates having a melting point of more than 1000° C., each metal plate having a through hole and attached to each respective end of the fuse casing, a pair of terminals respectively fitted to the two ends of the fuse casing in such a manner as to cover said metal plates, a fuse element disposed in the fuse casing in such a state that each end portion of the fuse element is passed through the through hole of each respective metal plate and electrically connected to the terminal attached thereto, said fuse element being able to fuse when subjected to an overcurrent, and notches formed at each end of the fuse casing in such a manner as to face the metal plate attached to said end.

In this embodiment, the fuse has such a structure that call for respectively attaching a pair of metal plates, each of which is provided with a through hole and has a melting point of more than 1000° C., to the two lengthwise ends of a tubular fuse casing, fitting a pair of terminals to the lengthwise ends of the fuse casing in such a manner as to cover the metal plates respectively, passing the two ends of a fuse element through the through holes of the metal plates and electrically connecting the ends of the fuse element to said terminals respectively, and forming notches at each lengthwise end of the fuse casing in such a manner as to face the corresponding metal plate so as to increase the area of the surface of each metal plate exposed to the inner space of the fuse casing. As the metal plates are capable of reliably interrupting an overcurrent by absorbing more effectively the energy of an arc discharge occurring when the fuse element fuses due to the overcurrent, the fuse can be made small while improving its breaking performance.

A third embodiment is similar to the first described embodiment above, with the addition that each metal plate and a terminal associated therewith are formed as an integral body.

By forming each metal plate and a terminal associated therewith as an integral body so as to eliminate the necessity of producing each metal plate and terminal as a separate, individual body, the fuse has a simplified structure while having the same effects as those of a fuse according to the first embodiment.

DETAILED DESCRIPTION OF THE PREFERRED EMBODIMENT

Figure 1:
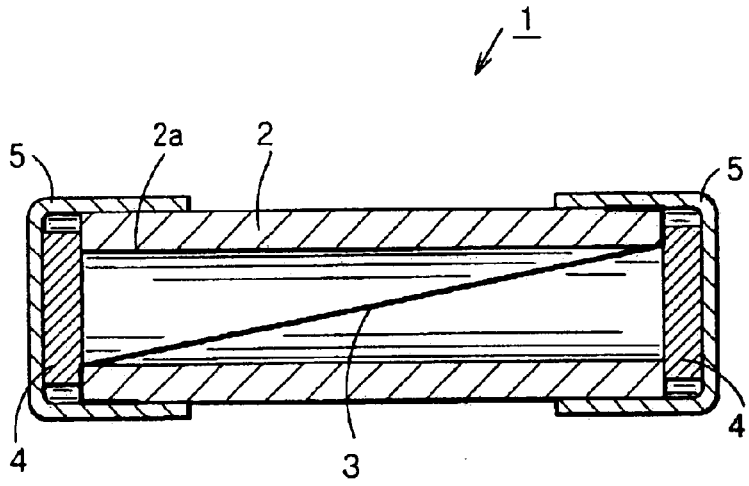
FIG. 1 is a sectional side view of a fuse according to the first embodiment of the present invention.
Figure 2:
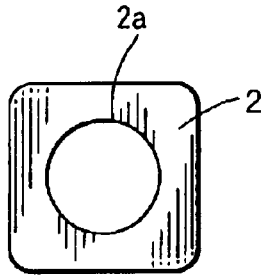
FIG. 2 is an end elevation of the fuse casing of said fuse.
Figure 3:
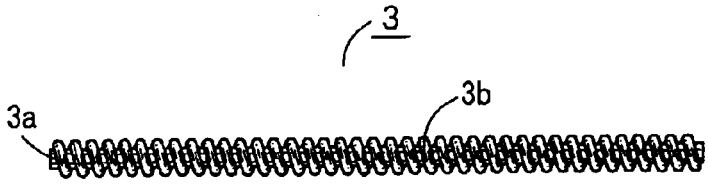
FIG. 3 is an enlarged plan view of a part of the fuse element of said fuse.

The structure of a fuse according to a first embodiment of the present invention is explained hereunder, referring to FIGS. 1 through 3.

Referring to FIG. 1, numeral 1 denotes a fuse to be mounted on a circuit or the like to be protected, which is not shown in the drawings. The fuse 1 has a fuse casing 2, which is formed of a ceramic or other heat-resistant, insulating material. As shown in FIG. 2, the fuse casing 2 has an outer shape that resembles a rectangular block. A nearly cylindrical through hole 2*a* extends through the fuse casing 2 in the direction of the length of the fuse casing 2 so that the fuse casing 2 has a tubular shape.

As shown in FIG. 1, an element 3 that serves as a fuse element is inserted through the through hole 2*a* of the fuse casing 2. FIG. 3 shows the structure of the element 3, which is formed by winding in a spiral a thin copper (Cu) wire 3*b* around an insulating core wire 3*a*, which is made of silica or the like.

As shown in FIG. 1, the element 3 is bent at one end thereof in a U-like shape when viewed in a cross section so that the bent portion extends from the inner surface through the corresponding end face to the outer surface of the fuse casing 2. Thus, the bent portion is engaged with one end of the fuse casing 2. Inside the through hole 2*a* of the fuse casing 2, the element 3 extends from said one end to the other end of the fuse casing 2 in such a manner as to diagonally traverse the fuse casing 2. In the same manner as said one end of the element 3, the other end of the element 3 is bent in a U-like shape when viewed in a cross section, and the bent portion is engaged with the other end of the fuse casing 2.

A pair of flat metal plates 4 are respectively attached to the two axial ends of the through hole 2*a*, which serve as the two ends of the fuse casing 2. The metal plates 4 are formed of a metal with a melting point of more than 1000° C. One of examples of such metals is copper, which has a melting point of approximately 1083° C. Each metal plate 4 is in the shape of a flat plate having a square or rectangular planar surface which is slightly smaller than the outer dimension of the fuse casing 2 and larger than the aperture area of the through hole 2*a* of the fuse casing 2 so that the two axial ends of the through hole 2*a* are closed off by the metal plates 4.

With the configuration as above, each end of the element 3 is securely sandwiched between each respective metal plate 4 and the corresponding end of the fuse casing 2.

The two ends of the fuse casing 2 are respectively pushed and thereby snugly fitted in a pair of caps 5, which serve as terminals. Each cap 5 is formed of a metal, such as copper treated with tin (5n) plating, in the shape of a short tube having a bottom and a square cross section. The inner shape of each cap 5 is similar to the outer shape of the fuse casing 2 so that frictional force between the outer surface of the fuse casing 2 and the inner surface of each cap 5 secures the cap 5 at each respective end of the fuse casing 2.

Each cap 5 is fitted over each respective end of the fuse casing 2 in such a manner as to cover the corresponding end portion of the fuse casing 2 and the element 3, as well as the metal plate 4 attached thereto. As a result, the element 3 is in contact with the inner surface of the caps 5. Thus, the element 3 is mechanically and electrically connected to the caps 5. Connection between the element 3 and the caps 5 is reinforced by heating the caps 5 or otherwise melting the tin plating on the caps 5 when the fuse 1 is in the assembled state.

Next, the function and effects of the first embodiment described above are explained hereunder.

Should an overcurrent flow into the fuse 1 mounted on a circuit (not shown) or the like to be protected, the overcurrent causes the element 3 to melt and vaporize instantly in the through hole 2*a*, so that an arc discharge occurs inside the through hole 2*a*.

At that time, the metal plates 4, which are respectively attached to both ends of the fuse casing 2 so as to close off the two axial ends of the through hole 2*a* of the fuse casing 2, protect the caps 5 from direct exposure to the arc discharge. As the metal plates 4 are made of copper, which has a melting point higher than 1000° C., the energy to melt the metal plates 4 exceeds the energy to sustain the arc discharge. As the metal plates 4 thus absorb the energy to sustain the arc discharge, the overcurrent is reliably interrupted.

Therefore, even if the internal space of the through hole 2*a* of the fuse casing 2 or the distance between the caps 5 is reduced as a result of the fuse casing 2 being made small, the metal plates 4 reliably interrupt overcurrent by absorbing the energy that sustains the arc discharge. The embodiment described above thus enables the fuse 1 to be made small while improving its breaking performance.

By using copper, which is a relatively inexpensive material, to form the metal plates 4, the embodiment permits reduction of the production cost of the metal plates 4 while improving its breaking performance.

In the configuration of the first embodiment described above, the bottom of each cap 5 may be formed thicker by forming each metal plate 4 integrally with a cap 5. A fuse provided with such caps 5 has a simplified structure while providing function and effects similar to those offered by the first embodiment.

Figure 4:
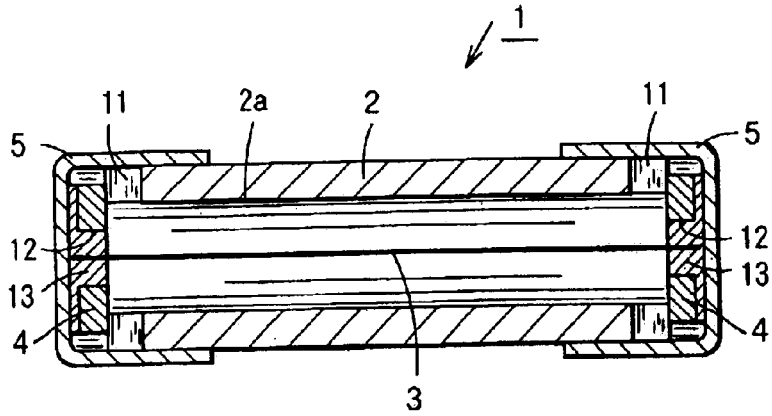
FIG. 4 is a sectional side view of a fuse according to the second embodiment of the present invention.
Figure 5:
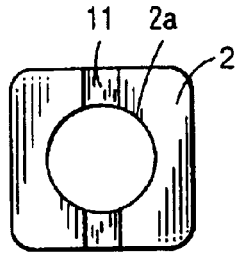
FIG. 5 is an end elevation of the fuse casing of said fuse.
Figure 6:
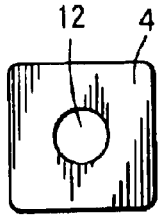
FIG. 6 is an end elevation of a metal plate of said fuse.

Next, a second embodiment of the present invention is explained, referring to FIGS. 4 through 6.

The structure of the embodiment shown in FIGS. 4 through 6 is basically the same as that of the embodiment shown in FIGS. 1 through 3. As shown in FIG. 5, however, a pair of notches 11 having an approximately rectangular cross section are formed at each lengthwise end of the fuse casing 2, respectively in two opposing sides of the fuse casing 2. As shown in FIG. 4, the outer end of each notch 11 faces a metal plate 4. Each notch 11 has a width slightly smaller than the diameter of the through hole 2*a* of the fuse casing 2.

As shown in FIG. 6, an aperture 12 serving as a through hole is formed through the approximate center of each metal plate 4. Each aperture 12 has a diameter smaller than that of the through hole 2*a* of the fuse casing 2.

As shown in FIG. 4, the element 3 is disposed along the center axis of the through hole 2*a* of the fuse casing 2. Each end of the element 3 is inserted through the aperture 12 of the corresponding metal plate 4 and soldered to the aperture 12 by solder 13. When viewed from the side, the solder 13 is approximately flush with the inner surface, i.e. the surface facing the through hole 2*a*, of the corresponding metal plate 4. Thus, the apertures 12 are closed off by the solder 13.

Each end of the element 13 is electrically connected to the inner bottom surface of each respective cap 5 by heating each cap 5 when the fuse 1 is in the assembled state so as to melt the solder 13 of the metal plate 4 that is in contact with the heated cap 5.

At that time, the gap between the inner bottom surface of each cap 5 and the surface of the corresponding metal plate 4 which faces the gap 5 is filled with the solder 13 so that the metal plate 4 and the cap 5 are electrically connected to each other without fail.

In the same manner as in the case of the embodiment shown in FIGS. 1 through 3, when the element 3 melts as a result of an overcurrent flowing into the fuse 1 mounted on a circuit (not shown) or the like to be protected, the element 3 vaporizes in the through hole 2*a* of the fuse casing 2 so that an arc discharge occurs inside the through hole 2*a*.

At that time, the structure that calls for exposing the metal plates 4 to the inner Space of the through hole 2*a* of the fuse casing 2 at the locations where the notches 11 are formed at the two ends of the fuse casing 2 prevents reduction in the performance characteristics of the metal plates 4 to absorb the energy of the arc discharge, which reduction would otherwise occur due to the presence of the apertures 12 of the metal plates 4. Therefore, the structure described above ensures reliable interruption of overcurrent by effectively absorbing the energy of an arc discharge by the metal plates 4.

In other words, even if the internal space of the through hole 2*a* of the fuse casing 2 or the distance between the caps 5 is reduced as a result of the fuse casing 2 being made small, the metal plates 4 reliably interrupt overcurrent by absorbing the energy that sustains the arc discharge. Therefore, as is true in the embodiment shown in FIGS. 1 through. 3, the present embodiment enables the fuse 1 to be made small while improving its breaking performance.

According to the second embodiment, the element 3 can be electrically connected to the caps 5 merely by soldering the element 3 to the metal plates 4 and heating the caps 5 after fitting the caps 5 over the two ends of the fuse casing 2. By thus facilitating electrical connection of the element 3 to the caps 5, the embodiment further improves the manufacturability of the fuse 1.

In either embodiment described above, the material for the metal plates 4 is not limited to copper; any metal having a melting point of more than 1000° C., e.g. stainless steel, may be used.

The fuse casing 2 may have an approximately cylindrical or any other shape, provided that a
sufficiently large internal space is ensured.

The shape of the metal plates 4 is not limited to a square or rectangular shape. It is essential, however, that the minimum dimension of its planar surface is greater than the diameter of the through hole 2*a* of the fuse casing 2.

The width or the number of the notches 11 is set according to the amount of overcurrent to be cut off.

Next, working examples according to the first embodiment and the second embodiment are explained hereunder, referring to Table 1 and Table 2.

As an example of a fuse 1 according to the first embodiment, Samples 1 were prepared. The fuse casing 2 of each Sample 1 was formed in a square tube with 2.7 mm sides and a length of 9 mm, with a through hole 2*a* having a diameter of 1.7 mm. Each metal plate 4 was formed of a stainless steel plate having a melting point of approximately 1400° C., with 2.4 mm sides and a thickness of 0.4 mm. Each cap 5 was formed of tinned copper in the shape of a bottomed square tube with 3.1 mm sides, a length of 2.5 mm, and a wall thickness of 0.2 mm.

As an example of a fuse 1 according to the second embodiment, Samples 2 were prepared. The fuse casing 2 of each Sample 2 was formed in a square tube with 2.7 mm sides and a length of 9 mm, with a through hole 2*a* having a diameter of 1.7 mm. Notches 11 with a depth of 0.5 mm were formed at each lengthwise end of the fuse casing 2. Each metal plate 4 was formed of a stainless steel plate which had a melting point of approximately 1400° C. and had been treated with 3 to 6 $\mu$m tin plating into a shape having 2.4 mm sides and a thickness of 0.4 mm, with an aperture 12 having a diameter of 1 mm formed therethrough. Each cap 5 was formed of copper treated with silver (Ag) plating in the shape of a bottomed square tube with 3.1 mm sides, a length of 2.5 mm, and a wall thickness of 0.2 mm.

Samples 3 were prepared in the same manner as Samples 2 described above except that the metal plates 4 were formed of copper plates.

As a comparison example to ascertain the impact of the different melting points of the metal plates 4, Samples 4 were prepared in the same manner as Samples 2 described above except that the metal plates 4 were formed of brass plates having a melting point of less than 800° C.

As a comparison example to ascertain the effect of the notches 11 formed at the two lengthwise ends of the fuse casing 2, Samples 5 were prepared in the same manner as Samples 2 described above except that no notches 11 were formed in the fuse casing 2.

Comparison Samples were prepared in the same manner as Samples 1 described above except that no metal plates 4 were provided.

By using 10 each of Samples 1 through 5 in addition to Comparison Samples, a test was performed to evaluate the fusibility of the fuses with a 250 V, 50 Hz AC power supply, 100 A prospective short-circuit current, and a circuit having a power factor of 0.8. This test is hereinafter referred to as the first breaking test. The first breaking test was performed with the short circuit closed at various voltages and electrical angles.

Results of the first breaking test are shown in Table 1, wherein each successful breaking ratio is represented by a number of samples that achieved successful circuit breakage divided by a total number of samples.

TABLE 1

| | Successful Breaking Ratio |
|---|---|
| Sample 1 | 10/10 |
| Sample 2 | 10/10 |
| Sample 3 | 10/10 |
| Sample 4 | 3/10 |
| Sample 5 | 0/10 |
| Comparison Sample | 0/10 |

As shown in Table 1, the overcurrent was successfully cut off in all the samples of Samples 1 through 3. However, Samples 4 could achieve a successful breaking ratio of only 3/10, and Samples and Comparison Samples all failed to cut off the overcurrent.

By comparing the results achieved by Samples 1 through 3 with those of Comparison Samples, it is evident that fuses according to the first embodiment or the second embodiment described above have superior breaking performance.

By comparing the results achieved by Samples 2 with those of Samples 3, it is evident that the same function and effects as those of the first embodiment or the second embodiment can be achieved regardless of what material the metal plates 4 are formed of, provided that it has a melting point of more than 1000° C.

It is evident from comparing the results achieved by Samples 2 with those of Samples 4 that the metal plates 4 should desirably be formed of a metal that has a melting point of more than 1000° C. in order to achieve given breaking performance.

Furthermore, comparing the results achieved by Samples 2 with those of Samples 5 confirms that a structure where each metal plate 4 is provided with an aperture 12 requires notches 11 to be formed at the two lengthwise ends of the fuse casing 2 in order to achieve given breaking performance.

By using 20 each of Samples 1 through 5 in addition to Comparison Samples, a test was performed to evaluate the fusibility of the fuses with a 600 v, 50 Hz AC power supply, 60 A prospective short-circuit current, and a circuit having a power factor of 0.995. This test is hereinafter referred to as the second breaking test. The second breaking test was performed with the short circuit closed at various voltages and electrical angles.

Results of the second breaking test are shown in Table 2, wherein each successful breaking ratio is represented, in the same manner as in Table 1, by a number of samples that achieved successful circuit breakage divided by a total number of samples.

TABLE 2

| | Successful Breaking Ratio |
|---|---|
| Sample 1 | 20/20 |
| Sample 2 | 20/20 |
| Sample 3 | 20/20 |
| Sample 4 | 12/20 |
| Sample 5 | 6/20 |
| Comparison Sample | 2/20 |

As shown in Table 2, the overcurrent was successfully cut off in all the samples of Samples 1 through 3. However, Samples 4 and 5 produced less successful breaking ratios: 12/20 for Samples 4 and 6/20 for Samples 5. Comparison Samples produced a breaking ratio of only 2/20, lowest among all of the results.

In other words, the second breaking test produced results similar to those of the first breaking test.

As explained above, as the fuse element of the fuse according to the first embodiment is securely held between the two lengthwise ends of the tubular fuse casing and the pair of metal plates having a melting point of more than 1000° C., and the terminals are fitted over the metal plates, the metal plates protect the terminals from direct exposure to an arc discharge, which occurs when the fuse element fuses due to an overcurrent. Therefore, even if the internal space of the fuse casing or the distance between the terminals is reduced as a result of the fuse casing being made small, the metal plates reliably interrupt overcurrent by absorbing the energy that sustains the arc discharge. The fuse can thus be made small while achieving an improved breaking performance.

A fuse according to the second embodiment calls for respectively attaching a pair of metal plates, each of which is provided with a through hole and has a melting point of more than 1000° C., to the two lengthwise ends of a tubular fuse casing, fitting a pair of terminals to the lengthwise ends of the fuse casing in such a manner as to cover the metal plates respectively, passing the two ends of a fuse element through the through holes of the metal plates and electrically connecting the ends of the fuse element to said terminals respectively, and forming notches at each lengthwise end of the fuse casing in such a manner as to face the corresponding metal plate so as to increase the area of the surface of each metal plate exposed to the inner space of the fuse casing. As the metal plates are capable of reliably interrupting an overcurrent by absorbing more effectively the energy of an arc discharge occurring when the fuse element fuses due to the overcurrent, the fuse can be made small while improving its breaking performance.

According to the structure of the fuse according to the third embodiment, each metal plate and a terminal associated therewith are formed as an integral body. By eliminating the necessity of producing each metal plate and terminal as a separate, individual body, the fuse has a simplified structure while having the same effects as those of a fuse of the first embodiment.

What is claimed is:

1. A fuse including:

a tubular fuse casing;

a pair of metal plates which are respectively attached to the two ends of the fuse casing and have a melting point of more than 1000° C.;

a pair of terminals respectively fitted to two ends of the fuse casing in such a manner as to cover said metal plates; and a fuse element disposed in the fuse casing with each end portion of the fuse element electrically connected to each respective terminal in such a state as to be held between each respective end of the fuse casing and the metal plate attached thereto, said fuse element being able to fuse when subjected to an overcurrent.

2. The fuse according to claim 1, wherein each metal plate and a terminal associated therewith are formed as an integral body.

3. A fuse including:

a tubular fuse casing;

a pair of metal plates having a melting point of more than 1000° C., each metal plate having a through hole and attached to each respective end of the fuse casing;

a pair of terminals respectively fitted to the two ends of the fuse casing in such a manner as to cover said metal plates;

a fuse element disposed in the fuse casing in such a state that each end portion of the fuse element is passed through the through hole of each respective metal plate and electrically connected to the terminal attached thereto, said fuse element being able to fuse when subjected to an overcurrent; and notches formed at each end of the fuse casing in such a manner as to face the metal plate attached to said end.

* * * * *